United States Patent [19]

Westwell

[11] Patent Number: 4,968,182

[45] Date of Patent: Nov. 6, 1990

[54] COMBINATION DECK SUPPORT LEG HOLDER AND RUB STRIP

[75] Inventor: Leonard W. Westwell, Ottawa, Canada

[73] Assignee: Fendor Glass & Aluminum Ltd., Ottawa, Canada

[21] Appl. No.: 265,616

[22] Filed: Nov. 1, 1988

[30] Foreign Application Priority Data

Aug. 24, 1988 [CA] Canada ..... 575 567

[51] Int. Cl.[5] ..... E02B 3/26

[52] U.S. Cl. ..... 405/215; 405/216; 405/221

[58] Field of Search ..... 405/212, 215, 216, 218, 405/219, 220, 221

[56] References Cited

U.S. PATENT DOCUMENTS

| | | | |
|---|---|---|---|
| 3,426,542 | 2/1969 | Hindman et al. | 405/221 |
| 3,953,980 | 5/1976 | Bennett | 405/221 |
| 4,041,716 | 8/1977 | Thompson | 405/219 |
| 4,087,977 | 5/1978 | Kuhlman | 405/218 |
| 4,227,832 | 10/1980 | Leone et al. | 405/215 |
| 4,548,150 | 10/1985 | Drewett | 405/212 X |
| 4,641,999 | 2/1987 | Korbuly | 405/215 |

FOREIGN PATENT DOCUMENTS

| | | | |
|---|---|---|---|
| 1098725 | 4/1981 | Canada . | |
| 1431672 | 4/1976 | United Kingdom | 405/215 |

*Primary Examiner*—Randolph A. Reese
*Assistant Examiner*—Arlen L. Olsen
*Attorney, Agent, or Firm*—Jordan and Hamburg

[57] ABSTRACT

There is provided a new and useful combination deck support leg holder and rub strip comprising a support leg holder comprising a first section adapted to have a support leg secured thereto, a second section adapted to be secured to a deck or dock, and means for securing a rub strip to be disposed about at least a part of the holder remote from the deck or dock, and a rub strip adapted to be secured to the means for securing and to be disposed about at least a part of the holder remote from the deck or dock.

8 Claims, 3 Drawing Sheets

COMBINATION DECK SUPPORT LEG HOLDER AND RUB STRIP

This application relates to decks and docks primarily for use with cottages along lakeshores and like locations.

BACKGROUND OF THE INVENTION

There has always been a need for a relatively light and portable dock structure, particularly for use by cottagers. It has been desirable to have a dock structure which could be placed in the water in the appropriate season and removed to avoid damage over the winter. This avoided the necessity for constructing large, expensive and space consuming piers at water's edge.

In more recent years ecological and environmental concerns have led to legislation in some jurisdictions which bans permanent structures along water fronts and permits only temporary or portable structure types. Such legislation has led to increased demand for improved deck structures.

A wide variety of such structures have been available for many years. Many of these use extruded aluminum frames with wood decking. Such structures originally suffered from a number of shortcomings, but have continuously been improved to the point where sturdy structures are now available with a substantial life expectancy.

There is, however, still room for improvement in various aspects of the structure. One area which has been troublesome for a number of years is in the manner of attaching the legs to the deck structure proper in decks which are supported on legs. Another problem has been in providing some means of mutual protection for the dock and boats which are moored to the dock. The present invention provides a very much improved leg holder and fender or rub strip combination.

PRIOR ART

While there are a substantial number of patents relating to various dock structures, these generally deal with the detail of overall dock construction and do not relate to the specific problems at which the present case is directed. One reference of interest is Canadian Pat. No. 1,098,725, issued Apr. 7, 1981 to Charles Kay. That patent illustrates a form of tubular leg support.

SUMMARY OF THE INVENTION

A leg support and rub strip combination has now been discovered which provides exceptional stability to the dock legs and, as well, serves to prevent contact and mutual damage as between the deck structure and a boat or other water craft moored to the dock.

Accordingly, the invention provides, for use in a dock or deck structure, a combination deck support leg holder and rub strip comprising a support leg holder comprising a first section adapted to have a support leg secured thereto, a second section adapted to be secured to a deck or dock, and means for securing a rub strip to be disposed about at least a part of the holder remote from the deck or dock, and a rub strip adapted to be secured to the means for securing and to be disposed about at least a part of the holder remote from the deck or dock.

In a preferred embodiment the first and second sections and the rub strip securing means comprise an integral aluminum extrusion.

BRIEF DESCRIPTION OF THE DRAWINGS

In drawings which illustrate embodiments of the invention.

Figure 1:
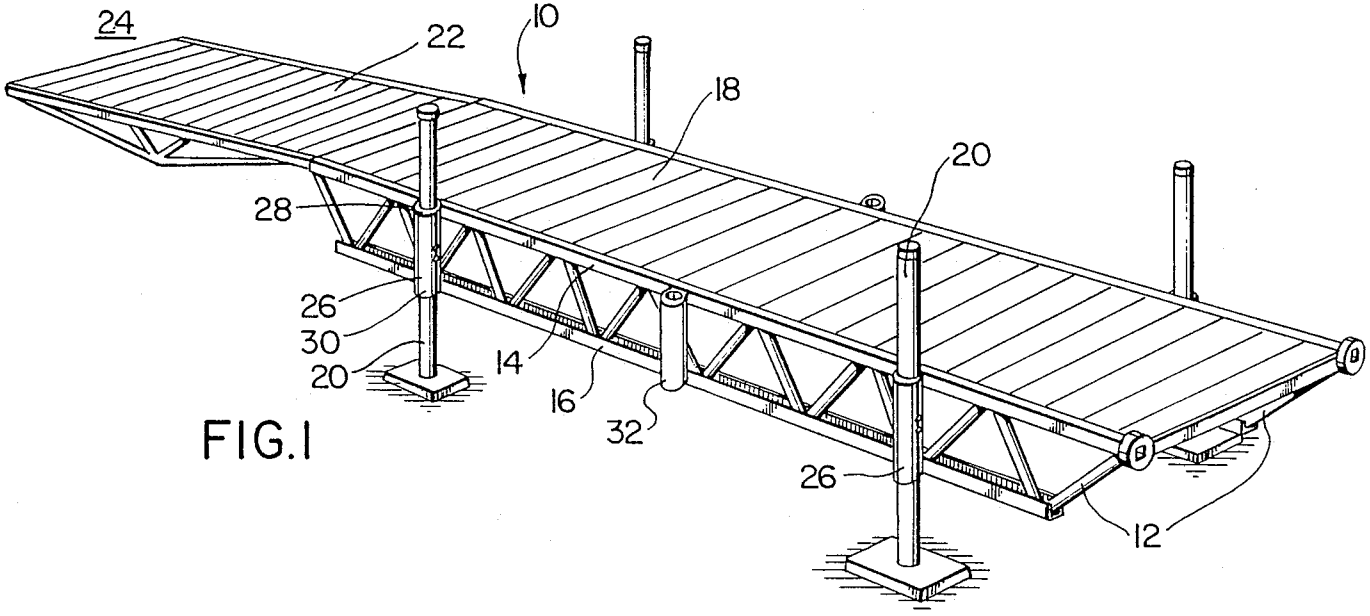
FIG. 1 is a perspective view of a dock structure incorporating the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The typical deck structure 10 comprises a pair of trusses 12 having upper and lower rails 14 and 16 respectively, carrying decking 18 and supported by legs 20. Ramp 22 connects the dock to shore 24.

Combination support leg and rub strip holders 26 are secured to deck structure 10. With the particular structure illustrated, a very stable unit 26 can be obtained by securing it at top 28 and bottom 30 to the upper and lower rails 14 and 16 respectively.

The particular unit 32 is used without a leg to provide an extra rub strip between the two units 26.

Figure 2:
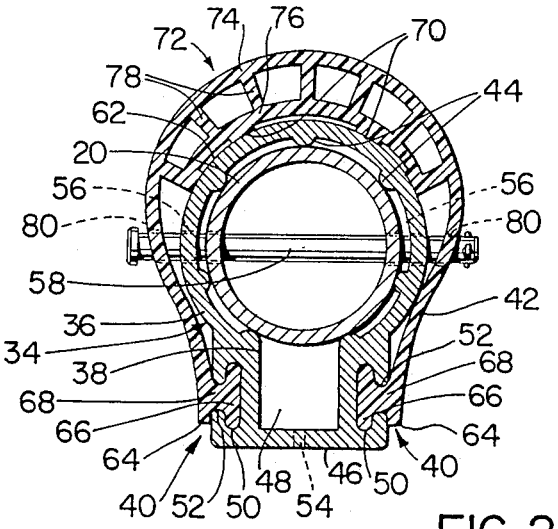
FIG. 2 is a cross section through a preferred embodiment of the invention.
Figure 3:
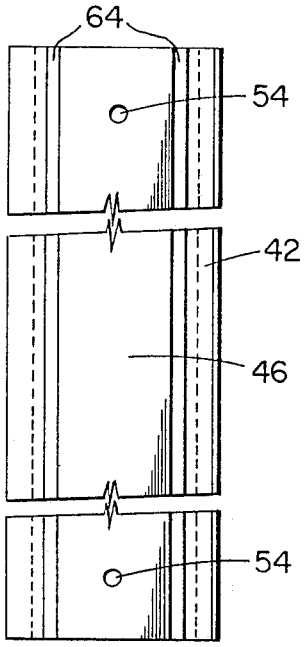
FIG. 3 is an elevation of one side of a structure according to the invention.
Figure 4:
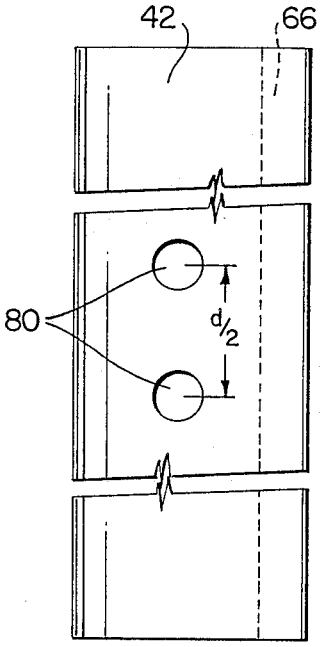
FIG. 4 is an elevation of a different side of a structure according to the invention.
Figure 5:
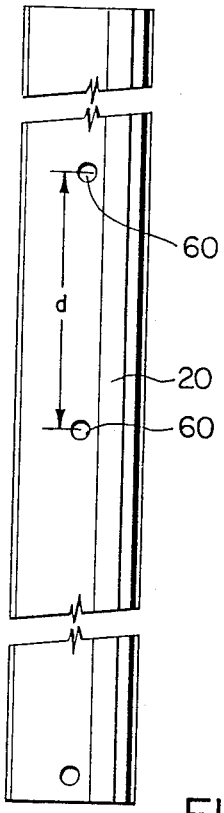
FIG. 5 is an elevation of a dock support leg for use in association with the invention.

Turning to FIG. 2, the leg holder 34 includes a first section 36 which is adapted to receive through it a deck support leg 20. Leg holder 34 includes a second section 38 which is designed to be secured against the deck structure 10.

As well, the leg holder 34 includes means 40 for securing rub strip 42 to leg holder 34.

In the preferred configuration for use with a tubular support leg 20, the inner profile of the first section 36 is circular. In the most preferred configuration to allow for easier insertion of leg 20 into leg holder 34, a series of spaced longitudinal ribs 44 are provided within section 36 to actually serve as the contact surfaces with the leg 20.

The second section 38 of leg holder 34 provides a flat surface 46 to fit snuggly against deck structure 10. The space 48 provides room for fastening devices to extend into leg holder 34 for fastening it to the deck structure 10 without interference with a leg 20 within the holder 34.

The first and second sections 36 and 38 of leg holder 34 are thus preferably integral channels.

Means 40 for securing rub strip 42 to the holder 34 preferably comprises a pair of profiled channels 50. Unlike the channel sections 36 and 38, which are preferably closed along their sides, channels 50 include longitudinal slots 52.

Channels 50 are preferably integral with second section 38.

The holder 34 preferably includes holes 54 through the flat surface 46 to accommodate fasteners such as screws, bolts or the like for securing holder 34 to deck structure 10. As well, the holder 34 preferably includes lateral openings 56 to receive a fastening device such as pin 58 for securing a leg 20 in position in the leg holder 34.

Figure 6:
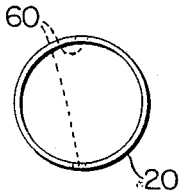
FIG. 6 is a cross section through the support leg of FIG. 5.

In order to obtain a good range of height adjustment of leg 20 to accommodate different water depths, the leg 20 as illustrated in FIG. 6 is provided with a series of openings 60 to receive the pin 58. The leg holder 34 preferably includes a set of at least two lateral openings 56 which are spaced from each other by a distance d/2 which is half the spacing between the openings 60 in leg 20. The spacing d/2 thus represents the size of the adjustment steps at which the leg can be secured. This distance is preferably about two inches.

The outer profile 62 of first section 36 of leg holder 34 can be varied as desired to support the rub strip 42. This profile is preferably essentially circular to avoid stress lines on rub strip 42.

Rub strip 42 is preferably disposed about substantially all of the exterior surface of the leg holder 34. In the preferred embodiment rub strip 42 is a fairly flexible material which can essentially be wrapped around leg holder 34. The edges 64 of rub strip 42 include guide rails 66 which are profiled to be slideable in a snug fit within the profiled channels 50. The slots 52 accommodate the necks 68 of guiderails 66.

In the preferred case the rub strip is comprised of PVC.

In order to permit the strip 42 and leg holder 34 to be more readily assembled, strip 42 preferably includes a series of spaced longitudinal ribs 70.

The rub strip 42 also preferably includes a shock absorbing section 72. Section 72 preferably comprises spaced layers 74 and 76 and longitudinal ribs 78 between layers 74 and 76.

The rub strip 42 must be sufficiently resilient to avoid damage to watercraft and at the same time have sufficient rigidity to provide suitable shock absorption.

The strip 42 is provided with lateral openings 80 to accommodate the pin 58.

Where the unit 32 is used without a leg, the pin 58 may still be utilized if desired to ensure that strip 42 does not slide off of holder 34.

Figure 7:
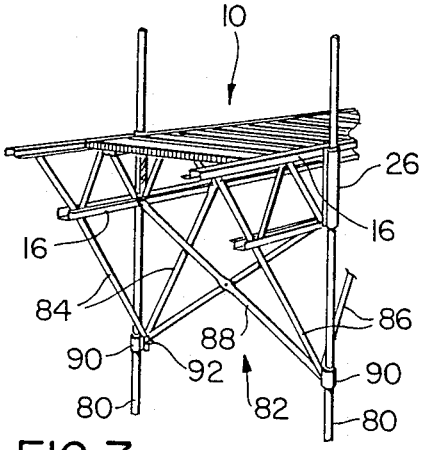
FIG. 7 is a perspective view of an additional function of the invention.

FIG. 7 illustrates an additional use in the dock structure 10 of the leg holder 34. That figure shows the outer end of structure 10 with a deeper water modification comprising longer legs 80 and bracing structure 82. Bracing structure 82 comprises the struts pairs 84 and 86 and the cross brace unit 88.

Mounted on the legs 80 are the additional leg holder sections 90 which comprise truncated sections of the above described leg holders 34. The sections 90 may be attached to legs 80 in the same manner as the full length units 34.

The sections 90 include the same flat side 46 with openings 54 as do the units 34. In this case, however, fasteners are not required to fasten the sections 90 to the deck structure, so the openings 54 are available to receive fasteners 92 to secure the lower ends of bracing structure 82. The upper ends of the bracing structure are secured to lower rails 16.

The leg holder section 90 thus aids materially in bracing the longer legs 80.

Thus it is apparent that there has been provided in accordance with the invention a combination deck support leg holder and rub strip that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. For use in a dock or deck structure, a combination holder for a deck support leg and for a rub strip, comprising an integral metal extrusion, said extrusion comprising a first elongated substantially closed channel structure having an inside profile adapted for receiving a leg therethrough and a convex outside profile, a second channel structure integral with and parallel to the first channel structure, the second channel structure comprising a pair of mutually opposed side walls integrally formed on the first channel structure and a third wall substantially perpendicular to the first and second walls and provided with an aperture therethrough for receiving a fastener for fastening the leg holder to the deck or dock, and respective guide channels formed in the outside surface of each of said first and second walls and parallel to said first and second channel structures, said guide channels being adapted to receive in sliding relationship a corresponding pair of guide rails on a rub strip.

2. The combination holder of claim 1 including a rub strip having a pair of guide rails adapted to be received in sliding relationship in said guide channels.

3. The combination holder of claim 2 wherein said guide channels and said guide rails are generally T-shaped.

4. The combination holder of claim 2 wherein said rub strip includes a two layer ribbed shock absorbing structure on at least one face thereof.

5. The combination holder of claim 2 wherein said rub strip includes a series of longitudinal ribs along the inside surface thereof.

6. The combination holder of claim 1 wherein at least a part of said first channel section is profiled to conform to the exterior profile of said support leg.

7. The combination holder of claim 6 wherein said first channel is profiled to receive therethrough a leg of circular cross section.

8. The combination holder of claim 7 wherein said first channel includes a series of internal longitudinal ribs.

* * * * *